United States Patent [19]

Rosenthal

[11] Patent Number: 5,065,912

[45] Date of Patent: Nov. 19, 1991

[54] BIASED SWIVEL CLOSURE

[75] Inventor: Karl-Heinz Rosenthal, Reichshof, Fed. Rep. of Germany

[73] Assignee: Bielsteiner Verschlusstechnik GmbH, Gummerbach, Fed. Rep. of Germany

[21] Appl. No.: 549,284

[22] Filed: Jul. 6, 1990

[30] Foreign Application Priority Data

Jul. 6, 1989 [DE] Fed. Rep. of Germany ..... 3922258

[51] Int. Cl.[5] ..... B67D 3/00

[52] U.S. Cl. ..... 222/517; 222/534; 222/536; 222/556

[58] Field of Search ..... 222/511, 513, 517, 518, 222/531-534, 536, 537, 498, 556, 545

[56] References Cited

U.S. PATENT DOCUMENTS

| | | | |
|---|---|---|---|
| 2,272,867 | 2/1942 | Cobel | 222/517 X |
| 2,937,794 | 5/1960 | Quandt | 222/517 X |
| 3,120,879 | 2/1964 | Warner | 222/517 X |
| 3,516,581 | 6/1970 | Micallef | 222/534 X |
| 4,124,151 | 11/1978 | Hazard | 222/517 X |
| 4,172,540 | 10/1979 | Erichson | 222/517 |
| 4,346,810 | 8/1982 | Kneissl | 222/517 X |
| 4,371,095 | 2/1983 | Montgomery et al. | 222/517 X |
| 4,487,342 | 12/1984 | Shy | 222/534 X |
| 4,625,898 | 12/1986 | Hazard | 222/517 |
| 4,645,086 | 2/1987 | Rosenthal | 222/536 X |
| 4,776,501 | 10/1988 | Ostrowsky | 222/517 |
| 4,911,337 | 3/1990 | Rosenthal | 222/517 X |
| 4,917,253 | 4/1990 | Dutt | 222/517 X |
| 4,962,869 | 10/1990 | Gross et al. | 222/536 X |

FOREIGN PATENT DOCUMENTS

| | | | |
|---|---|---|---|
| 0323779 | 7/1989 | European Pat. Off. | 222/532 |

*Primary Examiner*—Kevin P. Shaver

*Attorney, Agent, or Firm*—Dressler, Goldsmith, Shore, Sutker & Milnamow, Ltd.

[57] ABSTRACT

A biased swivel closure is provided for a container and includes a cap cover which is pivotably mounted to a closure cap for pivoting between a closed position sealing a discharge nozzle and an open position. The cap cover is normally biased to the closed position by a pretensioning device which is connected between the cap cover and the closure cap. The pretensioning device includes an inverted V-shaped leaf spring having first and second legs which are spread outwardly in an arc shape in the untensioned state when the cap cover is removed from its mounting in the closure cap. When the cover is pivotably mounted in the closure cap and oriented obliquely downwardly and generally in the same plane and parallel to one another with the root connection of the two legs resting on a portion of the closure cap.

6 Claims, 1 Drawing Sheet

BIASED SWIVEL CLOSURE

Figure 1:
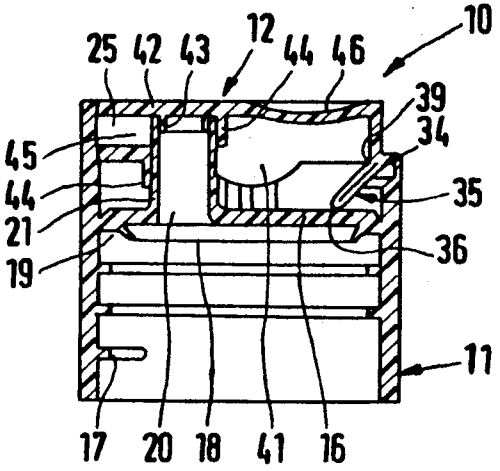

The invention relates to a biased swivel closure for containers containing free-flowing material as defined by the preamble of Patent Claim 1.

A biased swivel closure of this design is known from DE 3,829,023 A1. In said biased swivel closure, the pretensioning device may be linked optionally to the closure cap or the cap cover and may comprise at least one curved member which either projects downwards from the bottom side of the closure cap and interacts with an obliquely tapering surface of the coverplate or which projects upwards from the coverplate and rests against a sliding surface of the cap cover. The known pretensioning device develops its maximum pretensioning force as the cap cover swings increasingly into the open position, the restoring forces of the known pretensioning device not being adequate, as a rule, to return the cap cover automatically to the closed position.

The object of the invention is to improve the biased swivel closure as defined in the preamble of Claim 1 in a manner such that the pretensioning device applies, in every operating position of the cap cover, such a high pretensioning force to the latter that the cap cover is automatically returned completely to the closed position from its open position.

Because the pretensioning device comprises a V-shaped leaf spring, it is possible to give it a width such that, for this reason alone, a relatively high restoring force is ensured with respect to changes in shape. The essential point is, however, that the spring legs which are spread outwards in an arc in the untensioned state keep the cap cover under a comparatively high pretensioning force in the closed position of the latter. This is based on the fact that the spring legs, which extend essentially in one plane and parallel to each other in said closed position of the cap cover, are prevented from assuming their untensioned curved starting position again by the adjacent pivot-type linkages of the leg ends at the cap cover or at the upper edge of the closure cap. As a consequence of this, the bottom side of the side of the cap cover situated opposite the discharge opening is subjected to such a high pretensioning force even in the closed position of the latter that the cap cover reliably and automatically assumes the closed position when it is released in the open position. If the cap cover is to be swung out of the closed position into the open position by exerting a finger pressure on the side of the cap cover situated opposite the discharge opening, the linkage point between the cap cover and the associated leg end is moved in the direction of the leg root of the V-shaped spring and also towards the other leg linked to the cap edge, in which process the leg linked to the cap cover arches towards the side opposite the other leg, with the result that the restoring force of the spring increases.

Expediently the ends of the two spring legs are arranged, in the untensioned position in one plane which is directed roughly perpendicular to the angle bisector of the angle at the leg root.

Furthermore, the V-shaped leaf spring can be injection-moulded from plastic as a single entity with the biased swivel closure. This facilitates an economic mass production of the biased swivel closure.

The invention is explained in more detail below with reference to the diagrammatic drawing of an exemplary embodiment.

Figure 2:
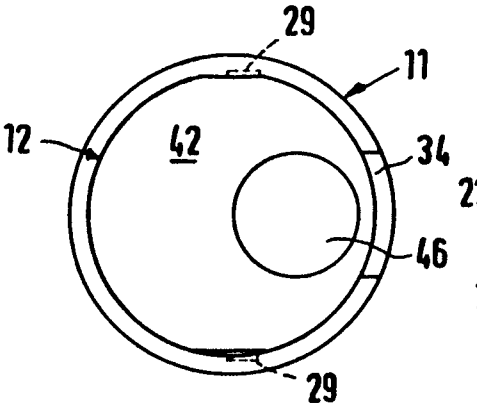
Figure 3:
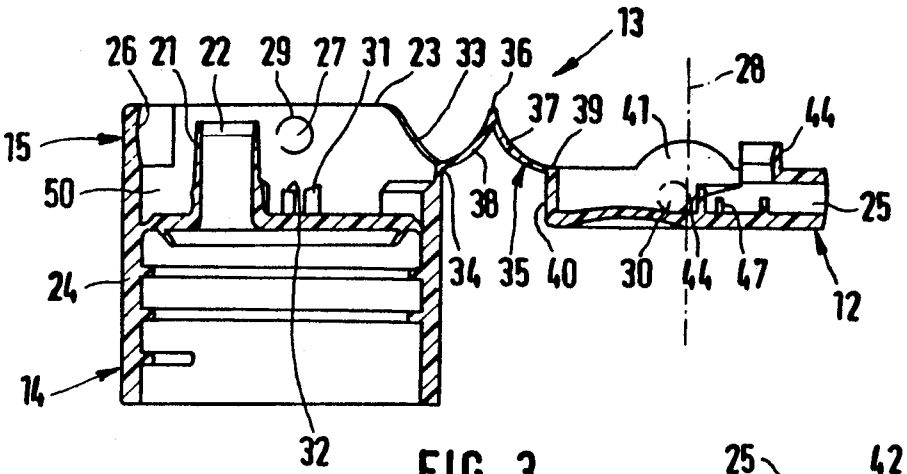
Figure 4:
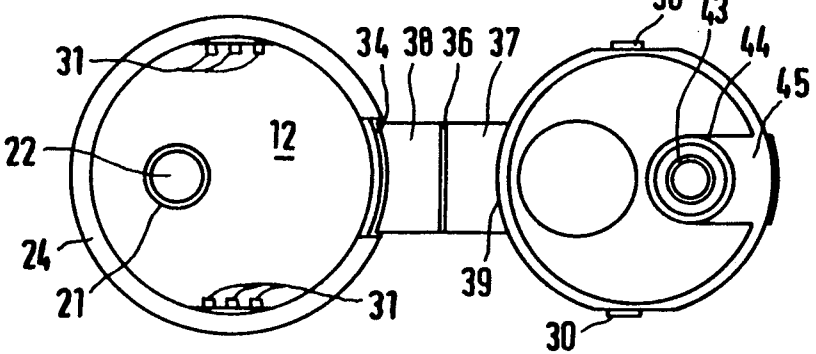
Figure 5:
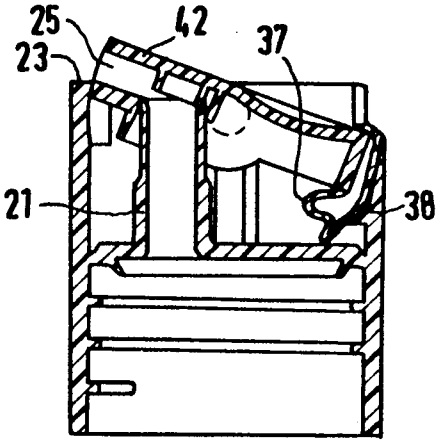

In the drawing:

FIG. 1 shows a perpendicular longitudinal section through the biased swivel closure in the closed position, FIG. 2 shows a plan view of the biased swivel closure, FIG. 3 shows a central longitudinal section through the biased swivel closure in the starting position, produced by injection moulding from plastic, with untensioned pretensioning device, FIG. 4 shows a plan view of the biased swivel closure in the starting position shown in FIG. 3, and FIG. 5 shows the biased swivel closure according to FIG. 1 in the open position.

The figures show a biased swivel closure 10 which comprises a cylindrical closure cap 11 and a cap cover 12 which is inserted in a cutout 50 in the closure cap 11. The closure cap 11 is produced by injection moulding from plastic as a single part with the cap cover 12 by a pretensioning device 13.

A bottom part 14 of the closure cap 11 is separated from a top part 15 by a coverplate 16.

The cylindrical bottom part 14 is provided with an internal thread 17 by means of which the closure cap 11 can be screwed onto the neck, provided with an external thread, of a container made of plastic, glass or the like, which is not shown. As a departure from this type of fixing, the closure cap can, of course, also be forced onto a container by means of a snap seating. The bottom side of the coverplate 16 is provided with a circular sealing lip 18 which extends at a distance from the inside wall of the closure cap 11 to form an annular groove 19 and rests elastically against the opening rim of the container neck to form a seal. Furthermore, the coverplate 16 is provided with a transfer opening 20.

Projecting above the transfer opening 20 into the top part 15 of the closure cap 11 is a discharge nozzle 21 whose upper discharge opening 22 is arranged at a distance below an upper rim 23 of a cylindrical cap wall 24 of the top part 15.

In FIGS. 1 and 2, the upper cap wall 24 is provided, at the level of the closed cap cover 12 and the outlet opening 25 thereof, with a spherically dome-shaped depression 26 on the inside of the cap wall 24, the radius of which depression is equivalent to the distance of said depression 26 from a swivel axis 27 of the cap cover 12. The lateral surface of the cap cover 12 is constructed in a correspondingly spherically domed manner in the region of the outlet opening 25 so that the cap wall 24 seals the outlet opening 25 with elastic pretensioning when the cap cover 12 is closed.

The pivot axis 27 of the cap cover is arranged so as to be offset towards the side opposite to the outlet opening 25 with respect to a central longitudinal axis 28. Provided coaxially with the swivel axis 27 and at roughly diametrically opposite sides of the inside of the cap wall 24 are bearings 29 in which guide studs 30 at roughly diametrically opposite sides of the cap cover 12 engage.

Below these depressions 29 there is a plurality of supporting ridges 31 which are arranged on the inside of the cap wall 24 and whose upper ends form a supporting surface 32 which is in the shape of a circular arc and whose centre of curvature is the swivel axis 27.

The upper edge 23 of the top part 15 of the closure cap 11 is provided with a cutout 33 at the side opposite the depression 26. In the deepest region of said cutout 33, the cap rim is articulated by means of a first pivot axis 34 at a leaf spring 35 which corresponds to an inverted V in FIG. 3 and which extends symmetrically to a diametrical axis over approximately ⅓ of the diameter of the cap cover. A leg root 36 of the leaf spring is accordingly directed upwards in FIG. 3, whereas the first and second legs 37, 38 are arched downwards in the untensioned state shown in FIGS. 3 and 4 and spread widely. At the same time, the spring ends at pivot axes 34 and 39, are situated roughly in one horizontal plane which is oriented perpendicularly to the angle bisector of the angle at the leg root 36. The first leg 37 is articulated by means of a second pivot axis 39 at the edge of an essentially cylindrical cover skirt 40 which projects downwards from the bottom side of the cap cover 12.

In the region of the guide studs 30 of the cap cover 12, the cover skirt 40 is provided with a pair of side plates 41 whose radius is essentially equivalent to that of the supporting surface 32 in the top part 24 of the closure cap 11 and which makes possible the swivelling movement of the cap cover 12 between its closed and open positions.

Provided on the bottom side of the head plate 42 is furthermore a closing member 43 which engages in the discharge opening 22 of the discharge nozzle 21 to form a seal. Provided at a radial distance from this closing member 43 so as to form a seal on the bottom side is a sealing cap 44 which encloses the discharge nozzle 21 so as to form a seal even in the open position of the cap cover 12 at the side facing away from the outlet opening 25, the sealing cap being situated, as shown in FIGS. 1 and 3, on the side facing the outlet opening below an outlet channel 45 which links the outlet opening 25 with the discharge nozzle 21 and, in the open position of the cap cover 12, links it via the latter with the interior of the container. In the open position, the closing member 43 is situated outside the discharge opening 22, with the result that the container contents can emerge through the discharge opening 22 into the outlet channel 45 and also through the outlet opening 25, which is then situated above the upper cap rim 23, into the open.

As FIG. 1 shows, the V-shaped leaf spring 35 is arranged in the closed position of the cap cover 12 in a manner such that the second pivot axis 39 is adjacent to the first pivot axis 34, and first and second leg 37, 38 are oriented, in opposition to their opening force, substantially in one plane and parallel to one another in the direction of the outlet opening 25 and also of the coverplate 16, the leg root 36 resting on the topside of the coverplate 16. The pretensioning force exerted by this deformation of the first and second legs 37, 38, which are curved in their untensioned starting position according to FIG. 3 is, of course, absorbed by the guide studs 30 of the cap cover 12 and the discharge nozzle 21. If the cap cover 12 in FIG. 1 is swivelled clockwise by exerting a finger pressure on the depression (actuating member 46) of a head plate 42, the outlet opening 25 is situated in the open position above the upper cap rim 23, as shown in FIG. 5. This takes place with an arc-type downward movement of the second pivot axis 39 on the cap cover 12. In this process pressure is applied to the entire leaf spring 35 in the direction of the inside of the cap wall 24 adjacent to it, the first leg 37 bending inwards with increasing pretensioning, whereas the second leg 38 is bent aside outwards, as clearly shown in FIG. 5. As a consequence of this, the leaf spring 35 exerts an intensifying pretensioning force on the cap cover 12 in the closure direction of the latter and endeavours to swivel the cap cover 12, when it is released by the actuating person, immediately back into the closed position according to FIG. 1, the pretensioning force due to the deformation of the originally curved first and second legs 37, 38 being so great that the cap cover 12 always reliably assumes its closed position again.

I claim:

1. A closure for a container defining an opening communicating with the container interior and from which a free-flowing material can be dispensed, said closure comprising:

a cap which can be mounted so as to form a seal on the opening of the container, said cap having a coverplate defining a topside and defining a discharge nozzle communicating with the interior of the container, said cap having a top part defining an upwardly open cutout and peripheral wall;

a cover mounted to said cap in said cutout above said coverplate for movement between a closed position occluding said nozzle and an open position permitting flow out of said nozzle; and a device connecting said cap and cover for elastically forcing said cover toward said closed position;

said cover defining a lateral outlet opening and an outlet channel for communicating between said lateral outlet opening and said discharge nozzle, said lateral outlet opening being occluded by said cap wall when said cover is in said closed position, said cover having a head plate over said outlet channel and having a closing member for occluding said discharge nozzle when said cover is in said closed position, said cap top part having bearings on the inside to define a swivel axis of said cover, said cover having lateral guide studs for engaging said bearings, said covering having supporting side plates which are of circular arc shape and which are concentric with said swivel axis, said cap top part having mating supporting surfaces on the inside to support said side plates to permit said cover to swivel between said closed and open positions, a portion of said cap wall generally opposite said lateral outlet opening having a rim defining an arc-shaped cutout, said cover having a skirt resting within said cap rim arc-shaped cutout and said cover defining an actuating member diametrically opposite said lateral outlet opening, said device including a generally V-shaped leaf spring having first and second legs each defining a root at one end from which said legs spread outwardly in an arc shape when the cover is removed from said cap and said legs are in the untensioned state;

said second leg being pivotally connected at an outer end to said cap rim at said arc-shaped cutout to pivot about a first pivot axis said first leg being pivotally connected at an outer end to said cover skirt to pivot about a second pivot axis said first and second pivot axes each being closely adjacent to both said cap rim and cover skirt when said cover is in said closed position, and when said cover is in said closed position, said first and second legs being oriented obliquely downwards under pretensioning roughly in the same plane and parallel to one another in the direction of the outlet opening and with their leg root resting on the topside of the coverplate.

2. The closure according to claim 1, wherein, when said cover is removed from said cap and said legs are in the untensioned state, the outer ends of said legs at said first and second pivot axes are situated in one plane which is oriented roughly perpendicularly to the angle bisector of the angle at the leg root.

3. The closure according to claim 1 or 2 wherein said V-shaped leaf spring is injection-molded from plastic unitary with said closure.

4. A closure for a container defining an opening communicating with the container interior from which material can be dispensed, said closure comprising:

a cap for being mounted on said container over said opening, said cap defining a peripheral wall and a coverplate which is recessed from the end of said wall and which extends over said container opening, said coverplate defining a discharge opening for communicating with the container interior;

a cover pivotally mounted within said peripheral wall on said cap over said coverplate for being pivoted between a closed position occluding flow through said discharge opening and an open position permitting flow through said discharge opening; and a spring device connecting said cap and cover to force said cover toward said closed position, said spring device having a pair of legs each having a first end connected together, said legs generally diverging from each other in the unstressed state of said device when said cover is removed from said cap, one of said legs being pivotally connected at a second end to said cap and the other of said legs being pivotally connected at a second end to said cover, said legs having a less divergent configuration when said cover is mounted in said cap in the closed position with said connected first ends engaging said coverplate.

5. The closure according to claim 4 in which said spring device has a generally V-shaped configuration in the unstressed state when said cover is removed from said cap.

6. The closure according to claim 4 in which said legs are substantially parallel when said cover is mounted in said cap in the closed position.

* * * * *